US006845821B2

(12) United States Patent
Bouma et al.

(10) Patent No.: US 6,845,821 B2
(45) Date of Patent: Jan. 25, 2005

(54) APPARATUS AND METHOD FOR DOWNHOLE FLUID SEPARATION

(75) Inventors: Jelle Sipke Bouma, Amsterdam (NL); Eric Johannes Puik, Rijswijk (NL); Paulus-Henricus Joannes Verbeek, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/332,193

(22) PCT Filed: Jul. 6, 2001

(86) PCT No.: PCT/EP01/07838

§ 371 (c)(1),
(2), (4) Date: Jan. 6, 2003

(87) PCT Pub. No.: WO02/02908

PCT Pub. Date: Jan. 10, 2002

(65) Prior Publication Data

US 2003/0116316 A1 Jun. 26, 2003

(30) Foreign Application Priority Data

Jul. 6, 2000 (EP) ..... 00305704

(51) Int. Cl.[7] ..... E21B 43/38; E21B 43/00

(52) U.S. Cl. ..... 166/369; 166/105.5; 166/265; 210/97; 210/170; 210/522; 210/747; 210/802

(58) Field of Search ..... 166/265, 369, 166/381, 105.5, 222, 263; 210/744, 747, 800, 802, 97, 170, 251, 519, 521, 522

(56) References Cited

U.S. PATENT DOCUMENTS 1,753,403 A * 4/1930 Cushman et al. ..... 210/521
2,190,104 A * 2/1940 McCoy ..... 166/105.5
3,182,799 A * 5/1965 Milos ..... 210/802
3,703,467 A * 11/1972 Lummus et al. ..... 210/522
3,893,918 A * 7/1975 Favret, Jr. ..... 210/744
4,589,984 A * 5/1986 Legrand et al. ..... 210/522
4,793,408 A 12/1988 Miffre
5,316,029 A * 5/1994 Campbell et al. ..... 134/104.1
5,443,120 A 8/1995 Howell
5,840,198 A * 11/1998 Clarke ..... 210/802
5,842,520 A 12/1998 Bolin
5,857,519 A 1/1999 Bowlin
5,860,476 A * 1/1999 Kjos ..... 166/265
5,979,559 A 11/1999 Kennedy
6,017,456 A * 1/2000 Kennedy et al. ..... 166/265
6,082,452 A * 7/2000 Shaw et al. ..... 166/105.5
6,367,547 B1 * 4/2002 Towers et al. ..... 166/265
6,554,066 B2 * 4/2003 Lopes et al. ..... 166/265

FOREIGN PATENT DOCUMENTS

| | | |
|---|---|---|
| FR | 2603205 | 3/1988 |
| FR | 2603206 | 3/1988 |
| WO | 98/02637 | 1/1998 |
| WO | 98/41304 | 9/1998 |

OTHER PUBLICATIONS

H.G. Polderman, et al., "Design Rules for Dehydration Tanks and Separator Vessels". SPE paper No. 38816—1997.

* cited by examiner

*Primary Examiner*—David Bagnell
*Assistant Examiner*—Jennifer H Gay

(57) ABSTRACT

This disclosure concerns a static oil/water separation chamber that is installed in a well extending to an underaround production formation containing hydrocarbon oil and water. The separation chamber has an inlet for receiving well fluid from a section below the separation chamber and two outlets. One outlet discharges a water-enriched component into a discharge well section, and the other outlet produces an oil-enriched component. The height of the separation chamber is larger than the thickness of the dispersion band that is formed under normal operating conditions.

14 Claims, 4 Drawing Sheets

APPARATUS AND METHOD FOR DOWNHOLE FLUID SEPARATION

FIELD OF THE INVENTION

The present invention relates to a well for producing oil from an underground formation. The invention relates in particular to a well, wherein a well fluid is separated underground, such that an oil-enriched component of the well fluid is produced to the earth's surface. It will be understood, that the earth's surface may also be the bottom of the sea.

BACKGROUND OF THE INVENTION

International patent application publication No.98/41304 discloses such a well having a horizontal section that includes the separation chamber.

U.S. Pat. No. 5,842,520 and U.S. Pat. No. 5,979,559 discloses such a well, wherein the separation chamber is located at substantially the same level as the production formation.

International patent application publication No.98/02637 discloses such a well, wherein the separation chamber is located at the level of the production formation, and wherein the static separator is a cyclone separator.

U.S. Pat. No. 4,793,408 discloses such a well, wherein the separation chamber is a small-diameter chamber located within a section of the well and having a side inlet for the well fluid, and wherein the separation chamber is provided with regulators for regulating the discontinuous withdrawal of effluents.

U.S. Pat. No. 5,443,120 discloses a cased well including a separation section in the casing adjacent the underground production formation, which is arranged for separating of at least a portion of the water from the well fluid.

U.S. Pat. No. 5,857,519 discloses a gas lift well including a separator arranged in the annulus between the casing and a tubing string and adjacent the underground production formation.

The known systems generally suffer from one or more drawbacks, including an insufficient degree of separation, complexity and high installation cost, limited robustness, limited operation window for oil production flow rates and watercut.

SUMMARY OF THE INVENTION

In the specification and in the claims, the expression 'well fluid' will be used to refer to a fluid comprising hydrocarbon oil and water. Further, hydrocarbon oil will be referred to as oil. The well fluid can further comprise gas.

There is an increasing need for efficient underground separation of water from a well fluid. Ideally, the well fluid is separated into oil and water, wherein the oil is sufficiently de-watered such that no or limited additional separation near the wellhead at the surface is needed prior to transport from the field, and wherein the water is of sufficient purity to allow injection into an underground formation.

Such a well wherein a well fluid is separated extends from the earth's surface to an underground production formation containing hydrocarbon oil and water. The well is provided with a separation chamber in which an oil/water separator is arranged comprising an inlet to receive well fluid, an outlet for an oil-enriched component opening into the well section above the separation chamber and an outlet for a water-enriched component opening into a deposition well section below the separation chamber.

It is an object of the present invention to provide a well that allows efficient, robust underground separation for well fluid into oil-enriched and water-enriched components.

It is another object of the present invention to provide a well for producing oil from an underground formation to the surface, wherein the oil can be de-watered below the surface, such that the water concentration of the produced oil is sufficiently low that no or limited further de-watering at the surface is needed.

It is a further object of the present invention, to provide a well comprising an underground separation chamber wherein the feed and the separated components flow vertically or nearly vertical in and out of the separation chamber.

To this end the present invention provides a well extending from the earth's surface to an underground production formation containing hydrocarbon oil and water, which well above the production formation is provided with a separation chamber in which a static oil/water separator is arranged comprising an inlet to receive well fluid from an inlet well section below the separation chamber, an outlet for an oil-enriched component opening into the well section above the separation chamber and an outlet for a water-enriched component opening into a discharge well section below the separation chamber, wherein the height of the separation chamber is larger than the thickness of the dispersion band that is formed therein under normal operation conditions.

The static separator in one particular embodiment further comprises a flow distributor means, arranged to distribute at a predetermined vertical position the well fluid received through the separator's inlet over the cross-sectional area of the separation chamber. The separator can further comprise a level detector means and a flow control means in order to maintain during normal operation an interface between two liquid layers at a predetermined level.

In an alternative embodiment, the static separator according to the present invention further comprises:

a stack of vertically spaced apart inclined plates, wherein between each pair of neighbouring plates a separation space is defined;

a substantially vertical inlet conduit communicating with the separator's inlet, which inlet conduit traverses the stack of plates and is arranged to receive the well fluid at its lower end, and is provided with one or more well fluid outlets each of which opens into a separation space;

a substantially vertical oil collection channel having an oil outlet at its upper end communicating with the separator's outlet for the oil-enriched component, which oil collection channel has one or more oil inlets, each oil inlet being arranged to receive fluid from the uppermost region of a separation space, wherein at least the plate immediately below each oil inlet is provided with a vertically upward pointing baffle; and a substantially vertical water collection channel having a water outlet at its lower end communicating with the separator's outlet for the water-enriched component, which water collection channel has one or more water inlets, each water inlet being arranged to receive fluid from the lowermost region of a separation space, wherein at least the plate immediately above each water inlet is provided with a vertically downward pointing baffle.

The expression height of the separation chamber is used in the specification and in the claims to refer to the shortest vertical distance between the outlet for the oil-enriched component and the outlet for the water-enriched component. The physical height of the separation chamber can be larger.

There is further provided a method of producing oil from an underground production formation through a well according to the present invention, which method comprises the steps of admitting well fluid into the separation chamber at a predetermined vertical position through one or more openings at a local flow velocity below 1 m/s;

allowing the well fluid to separate into a lower layer of a water-enriched component, a middle layer of an oil and water dispersion component and an upper layer of an oil-enriched component, withdrawing liquid from the upper layer and producing this liquid to the surface;

withdrawing liquid from the lower layer;

measuring the vertical position of the interface between two liquid layers; and controlling the flow rate of at least one of the inflowing well fluid, the outflowing water-enriched component or the outflowing oil-enriched component in dependence on the measured vertical position.

Applicant has found that from a practical point of view it is advantageous to arrange the separation chamber downstream of, and above the production formation, and that for such a configuration it is required that the height of the separation chamber is larger than the thickness of the dispersion band that is formed under normal operation conditions. Then, during normal operation a layer of relatively dry oil is formed above the dispersion band and a layer of relatively pure water below the dispersion band.

It has further been recognised that by separating the well fluid in an underground separation chamber one can take advantage of the physical conditions in the well, e.g. elevated temperature and pressure, which influence the separation behaviour of oil and water such that efficient separation of well fluid into relatively dry oil and relatively pure water can be achieved under practically and economically feasible conditions. According to a specific aspect of the invention, the efficiency of an underground separation chamber can be enhanced by using a separator comprising a stack of plates.

BRIEF DESCRIPTION OF THE DRAWINGS

The invention will now be described by way of example in more detail and with reference to the accompanying drawings, wherein.

DETAILED DESCRIPTION OF THE INVENTION

Well fluid received from an oil producing well typically contains more than 10 vol % of highly dispersed water. The separation behaviour under the influence of gravity of an oil/water dispersion containing more than 10 vol % of water can be described by means of a model. Applicant had developed the so-called Dispersion Band Model, see H. G. Polderman et al., SPE paper No. 38816, 1997. The model can be used to describe separation in a separation chamber. An important mechanism of separation is based on coalescence of small water droplets in the dispersion band, which sink to the lower layer once the drops have grown large enough. During normal operation, three liquid layers are formed in the separation chamber: a lower layer of relatively pure water, a middle layer containing an oil and water dispersion and an upper layer of relatively dry oil. The middle layer is also referred to as the dispersion band.

A result of this model is an equation for the dispersion band thickness $H_D$ (m) as a function of the specific throughput Q/A (m/s), wherein Q is the volumetric flow rate through the separation chamber of the fluid to be separated ($m^3/s$), and A is the horizontal cross-sectional area of the separation chamber ($m^2$).

The relation between the dispersion band thickness $H_D$ and the specific throughput Q/A can be described by the equation that has been experimentally verified $$H_D = \frac{a(Q/A)}{1 - b(Q/A)} \tag{1}$$

In this equation a and b are constants relating to the dispersion stability and they are a function of inter alia the kinematic viscosity of the oil component, the density difference between the oil and water components, and the drop size distribution of the dispersion. For oil having a kinematic viscosity of 0.001 Pa.s a stable dispersion is for example characterised by a=0.125 s, and b=0.078 s/m, whereas an unstable dispersion, which separates more readily, is for example characterised by a=0.05 s, and b=0.032 s/m.

Figure 1:
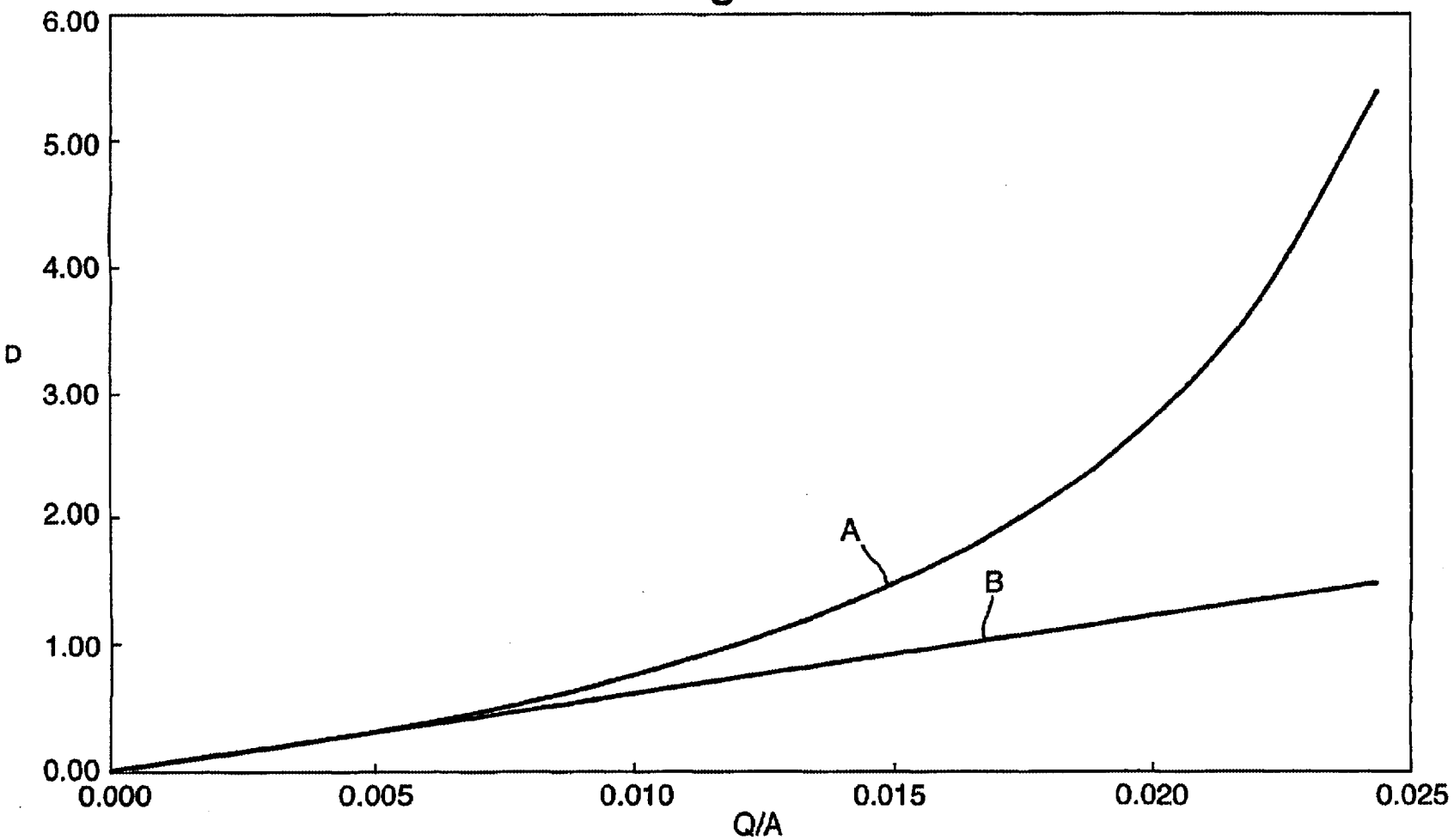
FIG. 1 shows the result of model calculations of the separation of a well fluid in a separation chamber with and without an installed stack of plates.

Reference is now made to FIG. 1, wherein curve A shows an example of the dispersion band thickness $H_D$ (on the ordinate, in m) as a function of the specific throughput Q/A (on the abscissa, in m/s), calculated with equation (1). In the calculations a=0.05 s and b=0.032 s/m have been used.

The dispersion band thickness $H_D$ at a given volumetric flow rate Q and cross-sectional area A determines the minimum height that is needed for a separation chamber in order that the upper oil layer and the lower water layer can be formed with the dispersion band between them. Similarly, an upper limit $Q_{max}$ for the volumetric flow rate can be calculated by solving equation (1) for a given cross-sectional area and height of the separation chamber, wherein it is assumed that $H_D$ is equal to the height of the separation chamber. The upper limit $Q_{max}$ divided by the volume of a separation chamber can be regarded as a measure for the efficiency of the separation chamber.

It will now be shown, that the efficiency of a separation chamber can be increased by installing a stack of vertically spaced apart inclined plates. Such a stack of vertically spaced apart plates is also referred to as a plate pack.

A plate pack subdivides the separation chamber into a number of separation spaces, wherein the space delimited between two neighbouring plates is referred to as a separation space having a thickness $H_P$ (m). In each separation space a dispersion band is formed, and the overall thickness of the dispersion band is equal to the sum of the thickness of all individual dispersion bands. In a first approximation, the overall thickness of the dispersion band equals the height of the plate pack ($n.H_P$) needed to fully confine the dispersion. $H_D$ can be calculated by the following modification of equation (1):

$$H_D = n \cdot H_P = n \cdot \frac{a(Q/A)}{n - b(Q/A)} \quad (2)$$

wherein $H_P$ is the vertical distance between neighbouring plates (m), n is the number of plates arranged at equal vertical distance in the plate pack, and wherein the other symbols have the meaning given hereinbefore.

Curve B in FIG. 1 has been calculated for a plate pack with $H_P$=0.3 m, using the same values for a and b as for the calculation of Curve A. At Q/A=0.005 m/s the dispersion can be fully confined within 0.3 m, thus within a single pair of plates. At Q/A=0.020 m/s the dispersion can be fully confined within 1.2 m, thus within a stack of 5 plates defining 4 separation spaces of 0.3 m height each.

In contrast, curve A at 0.020 m/s gives a dispersion band thickness of ca. 2.7 m when no plate pack is used. This demonstrates that by using a plate pack a separation chamber of smaller height can handle the same specific throughput as a larger separation chamber without a plate pack.

Figure 2:
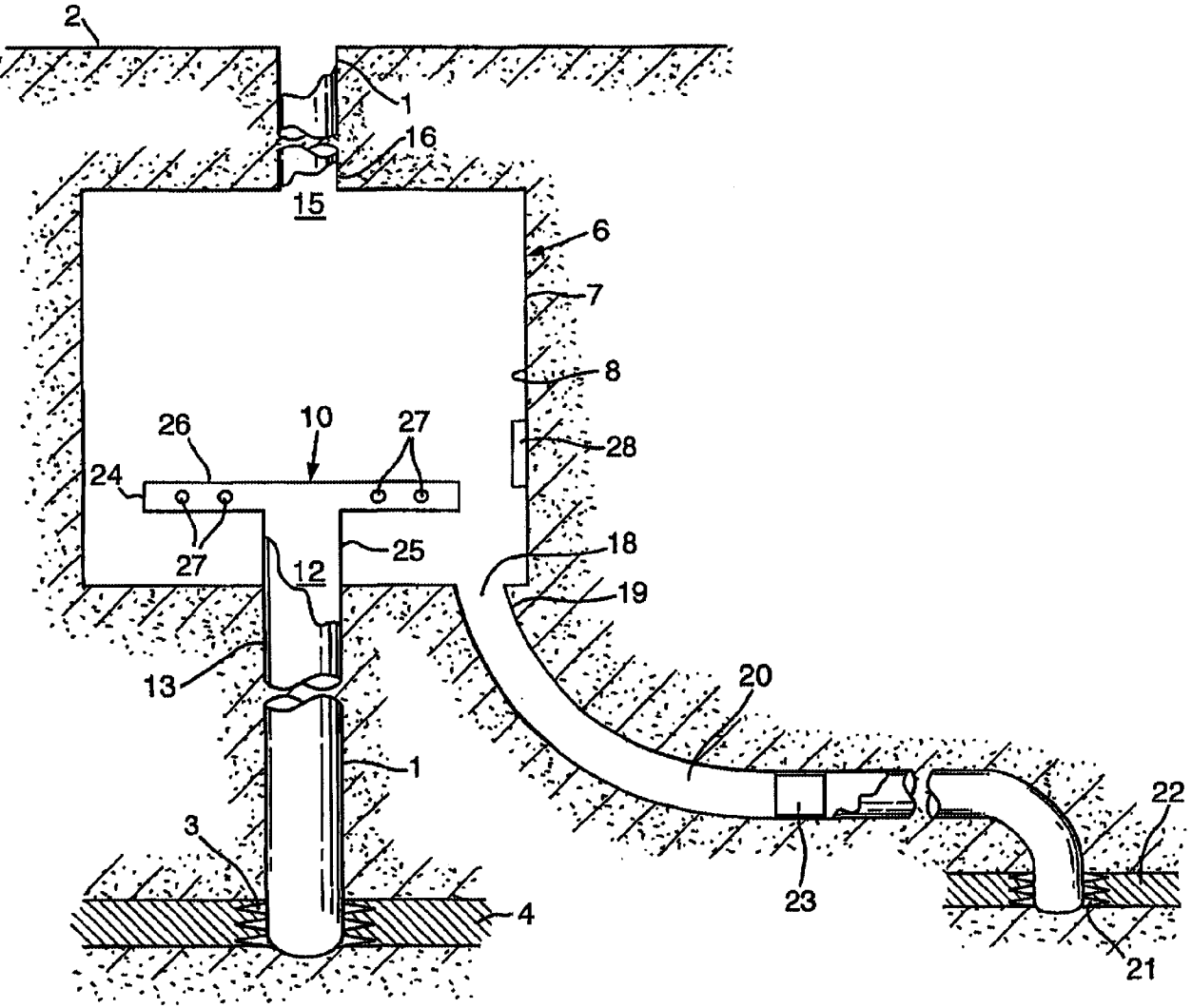
FIG. 2 shows schematically a first embodiment of the present invention.

Reference is now made to FIG. 2, which shows schematically a first embodiment of the present invention. The well 1, extending from the surface 2 to the underground production formation 4, is provided with a separation chamber 6 that is arranged in an underreamed section 7 of the well 1. The separation chamber 6 has a substantially circular cross section. The vertical-wall 8 of the separation chamber 6 is formed by the surrounding formation 9, but it will be understood that the wall can also be provided with a well tubular, such as a casing. The wall of the separation chamber also forms the wall of the separator.

In the separation chamber 6 there is arranged an oil/water separator 10 comprising an inlet 12 to receive well fluid from the inlet well section 13 below the separation chamber 6. The separator 10 further comprises an outlet 15 for an oil-enriched component opening into the well section 16 above the separation chamber 6 and an outlet 18 opening into a discharge well section 19 below the-separation chamber. The discharge well section 19 communicates with a water discharge system. The water discharge system comprises in this example a discharge well 20 that is provided with outlet means 21 to an underground formation 22 and a pump 23. The water discharge system further comprises means to prevent water from flowing back into the separation chamber (not shown).

The separation chamber 6 of the well 1 includes a static separator 10. The static separator 10 comprises a flow distribution means 24, which flow distribution means 24 comprises a vertical inlet conduit 25 having an inlet at its lower end in communication with the inlet 12 for well fluid of the static separator 10. The flow distribution means 24 further comprises an outlet conduit 26, which is in communication with the upper end of the inlet conduit 25. The outlet conduit 26 is provided with a number of outlet openings 27 that open into the separation chamber 6 at substantially the same vertical position. A level detector means 28 is arranged to detect the level of an interface between liquid layers, with advantage the level between the lower and middle layers. A signal generated by the level detector means 28 can with advantage be used to control the flow of the inflowing well fluid, the outflowing water-enriched component or the outflowing oil-enriched component in dependence on the measured vertical position. For example, the pump rate of a pump 23 of the water discharge system, which discharges the water-enriched component received at the outlet 18, can be controlled in order to keep the vertical position of the interface between the lower and middle layers within predetermined limits.

During normal operation a well fluid comprising a mixture of oil and water is received from the underground formation 4 through inlet means 3 and flows along the well 1. The well fluid present in the inlet well section 13 below the separation chamber can be well fluid as directly produced from the underground formation 4, or can represent a stream obtained after a primary separation, for example a component obtained after bulk water removal in a horizontal well section. Preferably, the well fluid entering the separator 10 at the inlet 12 contains between 10 vol % and 80 vol % of water.

The well fluid is received by the inlet conduit 25 from the inlet 12. The well fluid is admitted into the separation chamber via openings 27 at a predetermined vertical position. In this way, a relatively equal distribution of the well fluid over the cross-sectional area of the separation chamber is achieved which is advantageous for an efficient separation. In particular, the local flow velocity of the inflowing well fluid can be kept below 1 m/s, which is a critical value for most well fluids under practical conditions above which no efficient separation can be achieved. A lower layer of a water-enriched component will be formed, separated by an interface from a middle layer of water and oil dispersion (the dispersion band). The vertical position of the interface can be measured by the level detector means 28, this measurement can be used to control the rate of disposal through the outlet 18, and in this way the level of the interface can be regulated within predetermined limits. It can be chosen to arrange the interface just above, or below, the vertical position of the outlets from the flow distribution means 24.

On top of the dispersion band an upper layer of an oil-enriched component is formed. The oil-enriched component flows to the outlet 15 and on to the surface from where it is discharged at the wellhead (not shown). The oil-enriched component contains typically less than 10 vol % of water, preferably less than 2 vol %, more preferably less than 0.5 vol % of water.

The water-enriched component flows to the outlet 18 from where it is discharged via the water discharge system. The water-enriched component can contain between 0.01 vol % and 0.5 vol % of oil.

The outlet 15 is arranged to withdraw liquid from the region within the separation chamber 6, wherein during normal operation the upper layer is formed, and the outlet 18 is arranged to withdraw liquid from the region wherein the lower layer is formed. Preferably, like in this embodiment, the outlet 15 is arranged to withdraw fluid from the uppermost region of the separation chamber and outlet 18 is arranged to withdraw fluid from the lowermost region, so that the full physical height of the separation chamber is utilized.

The separation chamber 6 is so large that the dispersion band that is formed during normal operation fully fits into the chamber 6. Suitably, the ratio of the height to the effective diameter of the separation chamber is smaller than 10, preferably smaller than 5, wherein the effective diameter is defined as the diameter of a circle having the same cross-sectional area as the separation chamber.

It will be clear, that one or more outlet conduits of the fluid dispersion means 24 can be arranged in the form of a spider-like arrangement or a ring-like arrangement. Preferably, the outlet openings are arranged such that they admit the fluid into the separation chamber horizontally and tangentially with respect to the outer wall 8.

Figures 3, 4:
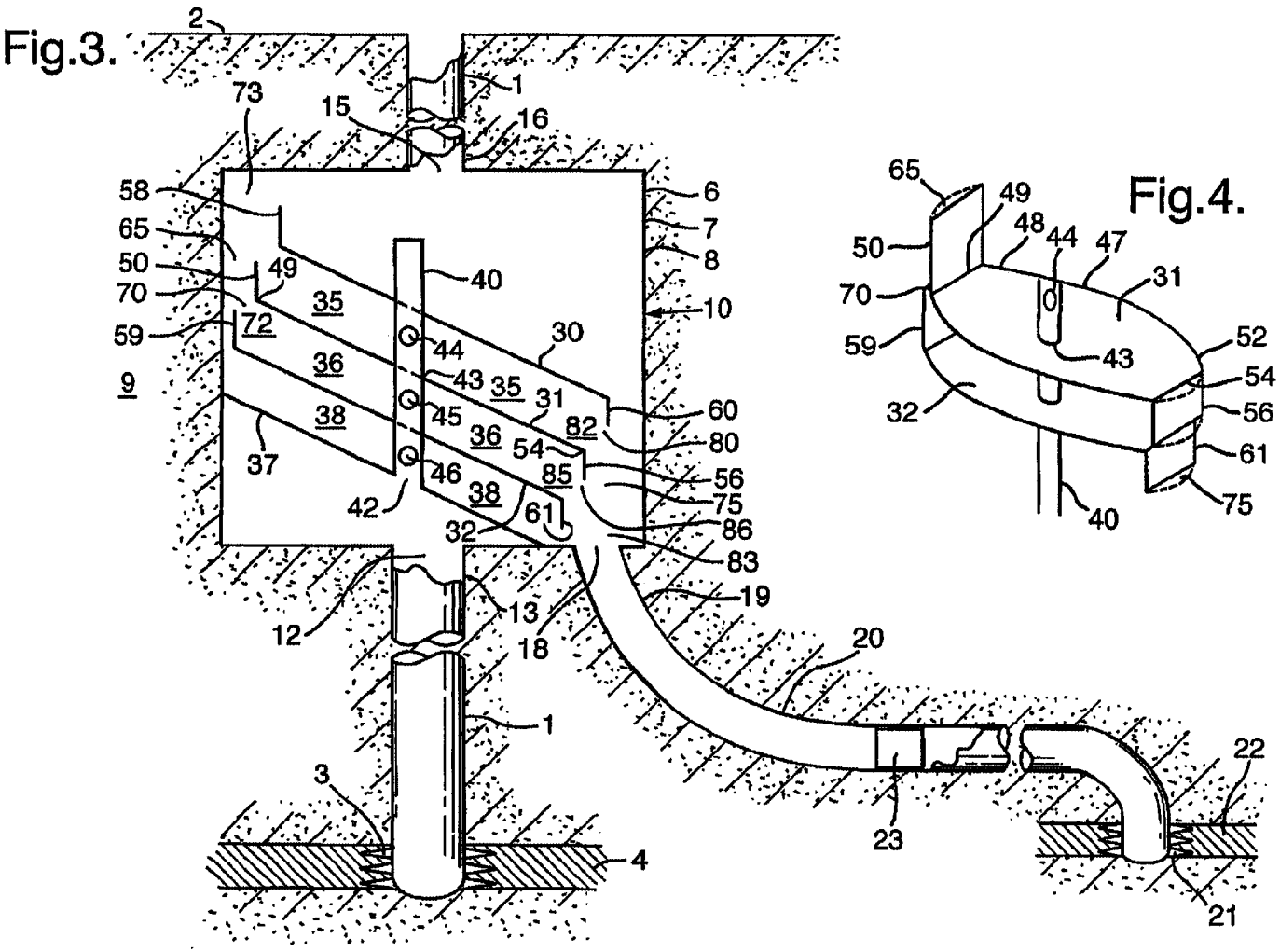
FIG. 3 shows schematically a second embodiment of the present invention.
FIG. 4 shows schematically a detail from the second embodiment of the present invention.

Reference is now made to FIGS. 3 and 4, which show a second embodiment of the present invention. In this embodiment, the static separator 10 further comprises a stack of inclined, substantially flat plates 30, 31, 32 that are arranged substantially parallel to each other and vertically spaced apart at an equal distance. The space delimited between two neighbouring plates is referred to as the separation space. For example, plates 30 and 31 define the separation space 35, plates 31 and 32 define the separation space 36. Underneath the lowest plate 32 of the stack of plates a parallel base plate 37 is arranged, wherein the outer rim of the base plate sealingly engages the walls of the separation chamber 6. Between the plate 32 and the base plate 37 a further separation space 38 is defined.

The stack of plates is traversed by the inlet conduit 40, which extends vertically upwardly from an opening 42 through the stack of plates in the centre of the separation chamber 6. The passage of the inlet conduit through a plate, for example the passage 43 through plate 31, is thereby arranged such that the wall of the inlet conduit 40 sealingly fits to the plate, for example plate 31, thereby preventing fluid communication between neighbouring separation spaces, for example separation spaces 35 and 36, along the inlet conduit. Further, the inlet conduit 40 is provided with radial outlet openings 44, 45, 46, which open into the separation spaces 35, 36, 38, respectively. It will be clear, that further outlet openings can be arranged opening into different radial directions. An outlet opening is with advantage arranged in the direction of the axis in the horizontal plane around which the plates are inclined, i.e. in FIG. 2 an axis perpendicular to the paper plane.

Further details about the inclined plates will now be discussed with reference to FIG. 4, wherein schematically the plates 31 and 32 of FIG. 3 are shown. The rim 47 of plate 31 includes at the upper side 48 of the plate 31 a straight edge 49 to which an upward pointing baffle plate 50 is attached. At the lower side 52 the rim 47 includes a straight edge 54 to which a downward pointing baffle plate 56 is attached.

Referring again to FIG. 3, the other inclined plates, of the stack of plates are similarly provided with upward and downward pointing baffles 58, 59, 60, 61 at the their upper and lower sides, respectively. The remaining parts of the rim of each inclined plate to which no baffle is attached are arranged to sealingly engage the wall 8.

The static separator 10 further comprises an oil collection channel 65, which is formed by the space segment delimited by the upward pointing baffles, 58, 50, 59, and the wall 8. The oil collection channel 65 comprises oil inlets, for example oil inlet 70 arranged to receive fluid from the uppermost region 72 of the separation space 36. Oil inlet 70 is defined by the upper edge 49 of the plate 31 and the upward pointing baffle 59 of the plate 32 immediately below the oil inlet 70. The oil collection channel 65 further comprises an outlet 73 in communication with the outlet 15 of the static separator 10.

Opposite to the oil collection channel 65 the separator 10 comprises a water collection channel 75, which is formed by the space segment delimited by the downward pointing baffles, 60, 56, 61, and the wall 8. The water collection channel 75 comprises water inlets, for example water inlet 80 arranged to receive fluid from the lowermost region 82 of the separation space 35. Water inlet 80 is defined by the lower edge 54 of the plate 31 and the downward pointing baffle 60 of the plate 30 immediately above the water inlet 80. The water collection channel 75 further comprises an outlet 83 in communication with the outlet 18 of the separator 10.

The plates 30, 31 and 32 with the attached baffles are arranged such that the shortest horizontal distance between an upward pointing baffle and the wall 8 increases from bottom to top, and that the shortest horizontal distance between a downward pointing baffle and the wall 8 increases from top to bottom. In this way the cross-sectional areas of both the oil collection channel 65 and the water collection channel 75 increase in the direction towards their respective outlets 73 and 83. Since the separator 10 does not contain parts that are moving during normal operation it represents a static oil-water separator.

During normal operation a well fluid comprising oil and water is received from the underground formation 4 through inlet means 3 and flow along the well 1. The well fluid present in the inlet well section 13 below the separation chamber can be well fluid as directly produced from the underground formation 4, or can represent a stream obtained after a primary separation, for example a component obtained after bulk water removal in a horizontal well section. Preferably, the well fluid entering the static separator 10 at the inlet 12 contains between 10 vol % and 80 vol % of water. The well fluid then enters the inlet conduit 40 at the opening 42 and is admitted into the interior of the separation spaces 35, 36, 38 via the outlet openings 44, 45 and 46. It has been found that good separation results are obtained if all openings have the same cross-sectional area. Good results have further been obtained if the diameter of the openings is of the order of the diameter of the inlet conduit, such that the pressure drop over the opening is small.

The separation will now be discussed. To this end we take a closer look on the separation space 36 between plates 31 and 32. In this separation space 36, three liquid layers are formed, an upper, oil-enriched layer, a middle dispersion band layer and a lower, water-enriched layer. The oil-enriched layer flows towards the uppermost region 72 of the separation space 36, from where it leaves the separation space to enter the oil collection channel through inlet 70. The water-enriched layer flows towards the lowermost region 85 of the separation space 36, from where it enters the water collection channel through inlet 86. Separation in the spaces 35 and 38 is similar.

The oil collection channel 65 receives an oil-enriched component from all separation spaces, and since the cross-section of the channel widens towards the outlet 73, the vertically upward flow velocity of the oil-enriched component in the channel 65 can remain substantially constant. From the outlet 73 the collected oil-enriched component flows to the outlet 15 above the stack of plates, and on to the surface from where it is discharged at the wellhead (not shown). The oil-enriched component contains typically less than 10 vol % of water, preferably less than 2 vol %, more preferably less than 0.5 vol % of water.

The water-collection channel 75 receives a water-enriched component from all separation spaces, and since its cross-section widens from top to bottom towards the outlet 83, the vertically downward flow velocity of the water-enriched component in the channel 75 can remain substantially constant. From the outlet 83 the collected water-enriched component flows to the outlet 18 below the stack of plates, from where it is discharged via the water discharge system. The water-enriched component can contain between 0.01 vol % and 0.5 vol % of oil.

The height of the separation chamber 6, i.e. the shortest vertical distance between the outlet for the oil-enriched component 15 and the outlet for the water-enriched component 18, in this embodiment coincides with the physical height of the separation chamber 6 in the underreamed section 7. The stack of plates in the separation chamber is arranged to fully confine the dispersion during normal operation, such that the region of the separation chamber above the stack of plates is filled with the oil-enriched component, and the region below the stack of plates is filled with the water-enriched component. As discussed with reference to FIG. 1, the height of the stack of plates can in first approximation be considered as the thickness of the dispersion band, since it is an upper limit for the sum of the thickness of all individual dispersion bands in the separation spaces.

Figure 5:
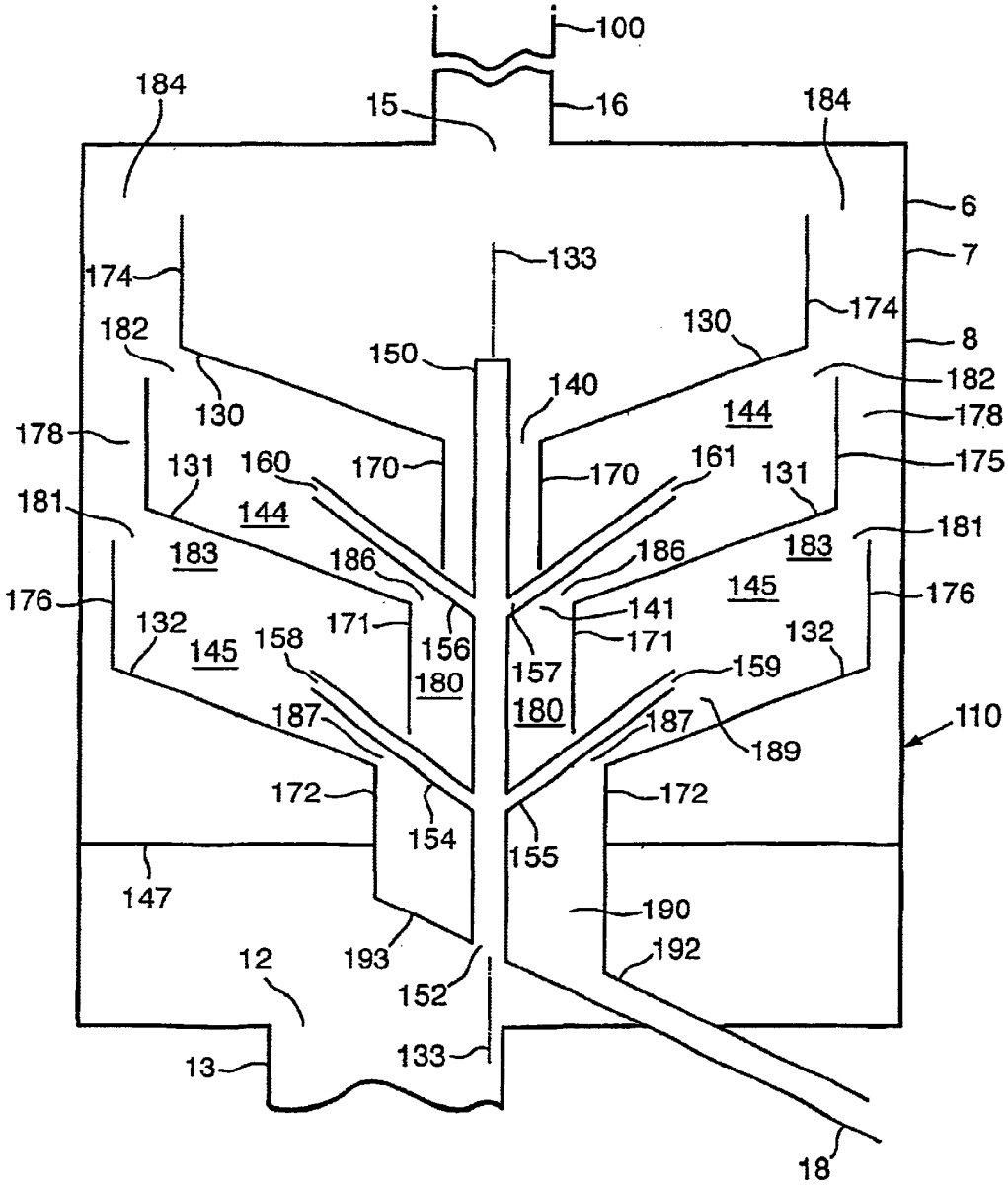
FIG. 5 shows schematically the separator region of a third embodiment of the present invention.

Reference is now made to FIG. 5. A further embodiment of a well 100 according to the present invention will now be described. FIG. 5 shows schematically the separation chamber 6 of the well 100. Parts that are similar to parts discussed with reference to FIG. 3 are referred to with the same reference numerals.

The inclined plates 130, 131 and 132, which form the stack of plates of the static separator 110, have the shape of funnels with substantially circular cross-section. The funnels in this embodiment are arranged such that they are narrowing from top to bottom. The funnels 130, 131 and 132 are stacked parallel to each other at equal distance and substantially along the central axis 133 of the separation chamber 6. Each funnel is provided with a central opening, 140, 141, and 142.

The space delimited between two neighbouring funnels is referred to as a separation space, FIG. 5 shows separation spaces 144 and 145. Underneath the lowest plate 132 of the stack of plates a horizontal, flat base plate 147 is arranged, wherein the outer rim of the base plate sealingly engages the walls of the separation chamber.

The stack of plates is traversed by the inlet conduit 150, which extends vertically upwardly from an opening 152 through the central opening of each of the funnels. The inlet conduit 150 comprises outlet conduits 154, 155, 156, 157. Each of the outlet conduits extends into the interior of a separation space where it is provided with an outlet opening, outlet openings 158, 159, 160, 161. It will be clear, that further outlet conduits and openings can be arranged opening into different directions.

To the whole rim of the central opening of each funnel a downward pointing baffle is attached, and to the whole upper rim of each funnel an upward pointing baffle is attached. The downward pointing baffles are schematically shown with reference numerals 170, 171, 172, and the upward pointing baffles with numerals 174, 175, 176. The oil collection channel 178 is formed by the annular space delimited by the upward pointing baffles 174, 175, 176 and the wall 8. Oil inlets 181, 182 to the oil collection channel 178 are defined by the annular regions between an upward pointing baffle 175, 176 and the upper rim of the upper adjacent funnel, 130, 131, respectively. For example, oil inlet 181 is arranged to receive an oil-enriched component from the uppermost region 183 of the separation space 145. The oil collection channel 178 further comprises an outlet 184 in communication with the outlet 15 of the separator 110.

The water collection channel 180 of the separator 110 is formed by the near-axial space delimited by the downward pointing baffles 170, 171, 172. Water inlets 186, 187 to the water collection channel 180 are defined by the annular regions between a downward pointing baffle 170, 171 and the rim of the adjacent circular opening, 141, 142, respectively. For example, water inlet 187 is arranged to receive a water-enriched component from the lowermost region 189 of the separation space 145. The water collection channel 180 further comprises an outlet 190 in communication with the outlet 18 of the separator 110.

The diameter of the upper rim increases from top to bottom, such that the cross-sectional area of the oil collection channel 178 increases towards the outlet 184. The cross-sectional area of the central openings, and therefore of the water-collection channel, increases from top to bottom, i.e. towards the outlet 190. The lowest downward baffle 172 close to the outlet 190 of the water collection channel traverses the base plate 147, wherein the outer circumference of the baffle 172 sealingly engages the base plate 147. The outlet 190 is communicating with the separator's outlet for the water-enriched component via conduit 192 which is attached to the lower rim of the downward baffle 172. In the transition wall 193 the opening 152 is arranged to which the inlet channel 150 is attached.

For the discussion of normal operation of the well 100 of this embodiment reference is made to the normal operation of the embodiment discussed with reference to FIGS. 2 and 3. In the following only the operation of the separator 110 will be discussed.

Well fluid is received by the static separator 110 in the same way at the inlet 12, and enters the inlet conduit 150 at the opening 152. The well fluid is admitted into the interior of the separation spaces 144, 145 via the outlet openings 158, 159, 160, 161. In a separation space, for example separation space 145, an upper, oil-enriched layer and a lower, water-enriched layer are formed. For example, in separation space 145 the oil-enriched layer flows towards the uppermost region 183, from where it leaves the separation space to enter the oil collection channel through inlet 181. The water-enriched layer flows towards the lowermost region 189 of the separation space 145, from where it enters the water collection channel through inlet 187. The oil-collection channel 178 receives an oil-enriched component from all separation spaces, and since the cross-section of the channel widens towards the outlet 184, the vertically upward flow velocity of the oil-enriched component in the channel 178 can remain substantially constant. From the outlet the collected oil-enriched component flows to the outlet 15. The oil-enriched component contains typically less than 10 vol % of water, preferably less than 2 vol %, more preferably less than 0.5 vol % of water.

The water-collection channel 180 receives a water-enriched component from all separation spaces, and since its cross-section widens from top to bottom towards the outlet 190, the vertically downward flow velocity of the water-enriched component in the channel 180 can remain substantially constant. From the outlet 190 the collected water-enriched component flows to the outlet 18 from where it is discharged via the water discharge system. The water-enriched component can contain between 0.01 vol % and 0.5 vol % of oil.

The baffles along the water and oil collection channels can be regarded as serving different purposes. They enclose the well fluid in the separation spaces such that the separation spaces can be regarded as being effectively decoupled. Further, the baffles prevent remixing of an already separated component in a collection channel with the fluid in a separation space, considering that the flow velocities in the collection channels are relatively high. The baffles help to realise that the vertical flows of inflowing well fluid and outflowing separated components are effectively decoupled.

It will be understood that one modification of the separator 110 shown in FIG. 5 can be obtained by arranging the stack of funnels upside down such that they are narrowing from bottom to top, and it will be clear that and how in such an arrangement the oil collection channel is formed in the near-axial region and the water-collection channel in the annular region of the separation chamber.

Another modification of the separator 110 can be obtained by sealingly attaching parts of the upper rims of the funnels to the outer wall, such that one or more oil collection channels are formed in space segments along the outer wall.

In yet another modification the inlet channel is arranged off-centre in the separation chamber, and sealingly traverses the stack of plates similar to the embodiment of the separator 10 in FIG. 3.

It will be clear that specific design parameters of a plate pack will depend on the practical situation. For example, the cross sectional area of the water collection and oil collection channels, relative to each other and to the separation chamber's cross sectional area, can be selected depending on the expected flow rates and the water content of the well fluid. The number of plates can be selected on the basis of calculations similar to FIG. 1 using the parameters of the practical situation. The inclination angle of the plates with respect to the horizontal plane is selected such that solid particles do not accumulate on the plates, but that the available separation volume is optimally used. Typically the inclination angle would be selected in the range between 10 and 45 degrees, preferably between 15 and 25 degrees, with respect to the horizontal plane.

In the discussion with reference to FIG. 1 it has become clear, that a stack of plates increases the separation efficiency of a separator in a separation chamber. In practice often a reduction of the required height of the separation chamber by a factor in the range of from 1.5 to 6 can be achieved. Sometimes, the height of the separation chamber is not a limiting factor for the well design, and in this case a separator without a stack of plates can be used.

Typical dimensions of the separation chamber 6 of the well as shown in FIG. 1 have been calculated using the Dispersion Band Model under the following assumptions: gross flow rate through the separator 1000 $m^3$/day of well fluid containing 50 vol % of water, dry oil viscosity 0.001 Pa.s. In this case a separation chamber of about 1 m diameter and 5 m height is required. For comparison it is noted that by installing a stack of plates in the separation chamber the height requirement can be decreased to for example 2 m.

What is claimed is:

1. A well extending from the earth's surface to an underground production formation containing hydrocarbon oil and water, where the well above the production formation is provided with a separation chamber in which a static oil/water separator is arranged, the static separator comprising: an inlet to receive well fluid from an inlet well section below the separation chamber;

an outlet for an oil-enriched component opening into the well section above the separation chamber;

an outlet for a water-enriched component opening into a discharge well section below the separation chamber, a dispersion band that is formed therein under normal operation conditions, wherein the height of the separation chamber is larger than the thickness of the dispersion band;

a stack of vertically spaced apart inclined plates, wherein between each pair of neighbouring plates a separation space is defined;

a substantially vertical inlet conduit communicating with the separator's inlet, where the inlet conduit traverses the stack of plates and is arranged to receive the well fluid at its lower end, and is provided with one or more well fluid outlets each of which opens into a separation space;

a substantially vertical oil collection channel having an oil outlet at its upper end communicating with the separator's outlet for the oil-enriched component, where the oil collection channel has one or more oil inlets, each oil inlet being arranged to receive fluid from the uppermost region of a separation space, wherein at least the plate immediately below each oil inlet is provided with a vertically upward pointing baffle; and a substantially vertical water collection channel having a water outlet at its lower end communicating with the separators outlet for the water-enriched component, where the water collection channel has one or more water inlets, each water inlet being arranged to receive fluid from the lowermost region of a separation space, wherein at least the plate immediately above each water inlet is provided with a vertically downward pointing baffle.

2. The well according to claim 1, wherein the static separator further comprises a flow distributor means, arranged to distribute at a predetermined vertical position the well fluid received through the separator's inlet over the cross-sectional area of the separation chamber.

3. A well according to claim 2, wherein the flow distributor means comprises one or more conduits in fluid communication with the separator's inlet for well fluid, which conduits are provided with outlet openings near the predetermined vertical position into the separation chamber.

4. The well according to claim 1, wherein the static separator further comprises a level detector means and a flow control means in order to maintain an interface between two liquid layers at a predetermined level during normal operations.

5. The well according to claim 1, wherein the inclined plates are substantially flat and arranged substantially parallel to each other, wherein each inclined plate is provided with a downward pointing baffle attached to the rim at the lower side of the inclined plate and an upward pointing baffle attached to the rim at the upper side of the inclined plate, wherein the remaining parts of the rim fit sealingly to the wall of the separation chamber, wherein the oil collection channel is formed by the space delimited by the upward pointing baffles and the wall, and wherein the water collection channel is formed by the space delimited by the downward pointing baffles and the wall.

6. The well according to claim 1, wherein the inclined plates have substantially the form of funnels arranged substantially parallel to each other, wherein each funnel is provided with a central opening.

7. The well according to claim 6, wherein the funnels are narrowing from top to bottom, wherein a downward pointing baffle is attached, and wherein an upward pointing baffle is attached to the upper rim, wherein the water collection channel is formed by the axial space delimited by the downward pointing baffles, and wherein the oil collection channel is formed by the annular space delimited by the upward pointing baffles and the wall.

8. The well according to claim 6, wherein the funnels are narrowing from bottom to top, wherein an upward pointing baffle is attached to the rim of each central opening, and wherein a downward pointing baffle is attached to the lower rim, wherein the oil collection channel is formed by the axial space delimited by the upward pointing baffles, and wherein the water collection channel is formed by the annular space delimited by the downward pointing baffles and the wall.

9. The well according to claim 1, wherein the cross-sectional area of the water collection channel increases from top to bottom.

10. The well according to claim 1, wherein the cross-sectional area of the oil collection channel increases from bottom to top.

11. The well according to claim 1, wherein the outlet openings of the inlet channel are the same size.

12. A method of producing oil from an underground production formation through a well containing hydrocarbon oil and water, where the well above the production formation is provided with a separation chamber in which a static oil/water separator is arranged, the static separator comprising:

a. an inlet to receive well fluid from an inlet well section below the separation chamber;

b. an outlet for an oil-enriched component opening into the well section above the separation chamber;

c. an outlet for a water-enriched component opening into a discharge well section below the separation chamber, d. a dispersion band that is formed therein under normal operation conditions, wherein the height of the separation chamber is larger than the thickness of the dispersion band;

e. a stack of vertically spaced apart inclined plates, wherein between each pair of neighbouring plates a separation space is defined;

f. a substantially vertical inlet conduit communicating with the separator's inlet, where the inlet conduit traverses the stack of plates and is arranged to receive the well fluid at its lower end, and is provided with one or more well fluid outlets each of which opens into a separation space;

g. a substantially vertical oil collection channel having an oil outlet at its upper end communicating with the separator's outlet for the oil-enriched component, where the oil collection channel has one or more oil inlets, each oil inlet being arranged to receive fluid from the uppermost region of a separation space, wherein at least the plate immediately below each oil inlet is provided with a vertically upward pointing baffle; and h. a substantially vertical water collection channel having a water outlet at its lower end communicating with the separator's outlet for the water-enriched component, where the water collection channel has one or more water inlets, each water inlet being arranged to receive fluid from the lowermost region of a separation space, wherein at least the plate immediately above each water inlet is provided with a vertically downward pointing baffle; comprising the steps of:

a. admitting well fluid into the separation chamber at a predetermined vertical position through one or more openings at a local flow velocity below 1 m/s;

b. allowing the well fluid to separate into a lower layer of a water-enriched component, a middle layer of an oil and water dispersion component and an upper layer of an oil-enriched component, c. withdrawing liquid from the upper layer and producing this liquid to the surface;

d. withdrawing liquid from the lower layer;

e. measuring the vertical position of the interface between two liquid layers; and f. controlling the flow rate of at least one of the inflowing well fluid, the outflowing water-enriched component or the outflowing oil-enriched component in dependence on the measured vertical position.

13. A method according to claim 12, including the step of controlling the flow rate to arrange the predetermined vertical position in the lower layer.

14. A method according to claim 12, including the step of controlling the flow rate to arrange the predetermined vertical position in the middle layer.

* * * * *